US007254357B2

(12) United States Patent
Umezawa et al.

(10) Patent No.: US 7,254,357 B2
(45) Date of Patent: Aug. 7, 2007

(54) METHOD AND APPARATUS FOR IMAGE FORMING CAPABLE OF EFFECTIVELY REGULATING A TONER LAYER, DEVELOPING MECHANISM FOR THE APPARATUS, AND A PROCESS CARTRIDGE PROVIDED IN THE APPARATUS

(75) Inventors: Nobuhiko Umezawa, Yokohama (JP); Yoshitake Shimizu, Higashi-Osaka (JP); Takafumi Miyazaki, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 91 days.

(21) Appl. No.: 11/094,538

(22) Filed: Mar. 31, 2005

(65) Prior Publication Data

US 2005/0226651 A1 Oct. 13, 2005

(30) Foreign Application Priority Data

Mar. 31, 2004 (JP) ..... 2004-108414

(51) Int. Cl.
*G03G 15/08* (2006.01)

(52) U.S. Cl. ..... 399/103; 399/284

(58) Field of Classification Search ..... 399/102, 399/103, 274, 284

See application file for complete search history.

(56) References Cited

U.S. PATENT DOCUMENTS 5,655,178 A * 8/1997 Ishikawa et al. ..... 399/102
5,697,021 A * 12/1997 Watanabe et al. ..... 399/102
5,913,094 A * 6/1999 Endo ..... 399/274 X
5,978,623 A * 11/1999 Itoh ..... 399/274 X
6,094,550 A * 7/2000 Kido et al. ..... 399/103
2002/0012553 A1* 1/2002 Endoh et al. ..... 399/284

FOREIGN PATENT DOCUMENTS

| | | |
|---|---|---|
| EP | 1 162 514 A2 | 12/2001 |
| JP | 10-177297 | 6/1998 |
| JP | 2002-099144 | 4/2002 |
| JP | 2002-182470 | 6/2002 |
| JP | 2003-316152 | 11/2003 |

OTHER PUBLICATIONS

U.S. Appl. No. 11/276,666, filed Mar. 9, 2006, Takehara et al.
Patent Abstracts of Korea, KR 1020010110317, Dec. 13, 2001, which we believe to corr. to JP 2002-099144, (previously submitted on Mar. 31, 2005).
Patent Abstracts of Korea, KR 1020040004033, Jan. 13, 2004.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming apparatus including a developer regulating member and sealing members. The developer regulating member regulates an amount of the developer carried by a developer carrying member, and has a center region having a first outer diameter of a first longitudinal cross-sectional region which increases toward an axial center portion of the developer regulating member according to a predetermined calculated amount of deflection of the developer regulating member, side regions located at axial end portions and having a second outer diameter of a second longitudinal cross-sectional region greater than a third outer diameter of a third longitudinal cross-sectional region obtained according to deflection of the developer regulating member. The sealing members have respective inner edges which sandwich boundaries of the center region and each of the side regions.

27 Claims, 7 Drawing Sheets

METHOD AND APPARATUS FOR IMAGE FORMING CAPABLE OF EFFECTIVELY REGULATING A TONER LAYER, DEVELOPING MECHANISM FOR THE APPARATUS, AND A PROCESS CARTRIDGE PROVIDED IN THE APPARATUS

CROSS-REFERENCE TO RELATED APPLICATIONS

The present patent application claims priority under 35 U.S.C. § 119 to Japanese patent application No. 2004-108414 filed on Mar. 31, 2004, in the Japanese Patent Office, the entire contents of which are hereby incorporated herein by reference.

BACKGROUND OF THE INVENTION

1. Field of the Invention

The present invention relates to a method and apparatus for electrophotographic image forming, a developing mechanism used in the apparatus, and a process cartridge including the developing mechanism. In particular, the present invention relates to a method and apparatus for electrophotographic image forming capable of effectively regulating a toner layer to form a uniformly thin layer and prevent toner overflow for producing a full-color image in good quality, a developing mechanism used in the apparatus, and a process cartridge including the developing mechanism and detachably provided to the image forming apparatus.

2. Discussion of the Background

Electrophotographic image forming apparatuses such as copiers, printers, and facsimile machines generally include an image bearing member, a charging unit, an optical writing unit, a developing unit, and a transfer unit for producing an image.

When forming an image, the charging unit uniformly charges a surface of the image bearing member, and the optical writing unit selectively emits a light beam according to image data and irradiates the surface of the image bearing member so that an electrostatic latent image is formed on the surface of the image bearing member. The developing unit then supplies one-component developer, for example, to visualize the electrostatic latent image to a toner image, and the transfer unit transfers the toner image formed on the surface of the image bearing member onto a transfer member provided in the image forming apparatus.

The developing unit using one-component developer generally includes a developer container, a developer carrying member, a developer supplying member, and a developer regulating member.

The developer container generally contains one-component developers. The developer carrying member is rotatably supported by the developer container and partially exposed from an opening of the developer container. The developer carrying member carries the developer on a surface thereof. The developer supplying member supplies the developer to the developer carrying member, and the developer regulating member regulates the developer on the surface of the developer carrying member.

When the developer supplying member supplies the developer to the surface of the developer carrying member, the developer regulating member regulates the developer on the surface of the developer carrying member to a layer having a predetermined height at a point in which the developer carrying member and the developer regulating member may contact, so that a developer layer having the predetermined height may be formed and be frictionally charged.

When a background image forming apparatus with such a developing unit allows a transfer medium having a size larger than an A3 size to be printed, an image bearing member of the background image forming apparatus may be extended in an axial direction according to the transfer medium, and, consequently, a developer carrying member and a developer regulating member may also be extended in an axial direction. These changes in lengths of the above-described members may cause a deflection to the developer regulating member that is applied with pressure exerted by pressuring members supporting the developer regulating member at both ends. The deflection may be greater toward the center of the developer regulating member in an axial direction. When deflection is generated on the developer regulating member, a contact pressure of the developer regulating member against the developer carrying member may vary along a surface of the developer regulating member. In particular, the axial center of the developer regulating member may have greater deflection so that a gap may be formed between the developer regulating member and the developer carrying member. Once the gap is formed, the developer regulating member cannot regulate the developer to the predetermined height on the surface of the developer carrying member and the layer of the developer may become higher at the axial center of the developer regulating member. The gap prevents the developer at the axial center of the developer carrying member from being evenly frictionally charged and increases the height of the developer layer. When the height of the developer layer increases, an amount of the developer also increases so that the developer at the center of the developer carrying member may have a substantially low charging quantity. Such substantially low charging quantity results in causing fogging in development and developer scattering.

To uniformly contact the developer regulating member with the developer carrying member, a technique in which a developer regulating member has nonuniform outer diameters of respective longitudinal cross-sectional regions of various potions thereof has been proposed. That is, a developer regulating member provided in a developing unit has an outer diameter of a longitudinal cross-sectional region at the center thereof greater than that at both ends thereof and is symmetrically formed thus centering the center thereof in an axial direction. The closer a portion is to the center, the more an amount of deflection increases and the greater an outer diameter of its longitudinal cross-sectional region of a developer regulating member becomes.

With the above-described structure, a developer regulating member may be pressed against a developer carrying member equally at any point on its surface contacting the developer regulating member, compared to a developer regulating member having a surface of a uniform outer diameter thereof. Thereby, a developer layer may be formed more uniformly.

When the above-described developer regulating member is used in the developing unit, however, a developer scraped by the developer regulating member may flow in an axial direction from the center of the developer regulating member toward each end thereof. The flow of developer is banked up by end sealing members that are provided for regulating a width of the developer layer formed on the developer carrying member. The developer stopped by the end sealing members may be accumulated to produce a pressure of developer powder in the vicinity of respective inner edges of the end sealing members and the amount of the developer powder pressure is substantially greater than that in any other areas of the developer carrying member. When the developer powder pressure increases in the vicinity of the respective inner edges of the end sealing members, a contact pressure of the developer regulating member against the developer carrying member cannot stop the developer at the end of the developer layer and allows the developer to flow in a rotation direction of the developer carrying member, which may allow excess developer for a developer layer to pass a contact point between the developer carrying member and the developer regulating member. Any developer that has passed the above-described contact point may be scattered from an opening of the developer container along with a rotation of the developer carrying member, which may result in a developer overflow. The developer overflow may contaminate an inside of the image forming apparatus and induce further contamination to the image bearing member and the developer carrying members having different colors from that of the leaked developer, which may result in deterioration of image quality.

SUMMARY OF THE INVENTION

Accordingly, one object of the present invention is to eliminate the above-described drawbacks.

Another object of the present invention is to provide a novel electrophotographic image forming apparatus capable of effectively regulating developer to form a uniformly thin layer and prevent toner overflow for producing a full-color image in good quality.

Another object of the present invention is to provide a novel developing mechanism used in the novel image forming apparatus.

Another object of the present invention is to provide a novel process cartridge including the novel developing mechanism and detachably provided to the novel image forming apparatus.

In one exemplary embodiment, a novel image forming apparatus includes an image bearing member, a developer carrying member, a developer regulating member, and sealing members. The image bearing member is configured to bear an electrostatic latent image on a surface thereof. The developer carrying member is configured to carry the developer on a surface thereof to the image bearing member. The developer regulating member is configured to regulate an amount of the developer carried by the developer carrying member. The developer regulating member may include a center region having a first outer diameter of a first longitudinal cross-sectional region which increases toward an axial center portion of the developer regulating member according to a predetermined calculated amount of deflection of the developer regulating member and side regions located at axial end portions, sandwiched in the center region therebetween, and having a second outer diameter of a second longitudinal cross-sectional region greater than a third outer diameter of a third longitudinal cross-sectional region obtained according to the predetermined calculated amount of deflection of the developer regulating member. The sealing members are configured to prevent the developer from leaking from the axial end portions of the developer carrying member. The sealing members have respective inner edges which sandwich boundaries between the center region and each of the side regions.

The above-described novel image forming apparatus may further include a developer container having an opening on a surface facing the image bearing member and configured to contain a developer. The developer carrying member may be disposed opposite to the image bearing member with a portion thereof exposed from the opening of the developer container. The developer regulating member may be pressed by respective pressuring members at the axial end portions and be held in contact with a surface of the developer carrying member. The center region of the developer regulating member may include an image assuring area configured to assure availability of an image. The sealing members may be disposed in contact with the surface of the axial end portions of the developer carrying member.

The first outer diameter of the first longitudinal cross-sectional region of the center region may vary according to a value obtained by a general formula for deflection of a simply supported beam with a uniform load applied. The second outer diameter of the second longitudinal cross-sectional region of each of the side regions may be constantly greater than a value obtained by the general formula.

The developer regulating member may be determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the developer regulating member at an axial end, and $d\phi$ expresses a difference between a maximum outer diameter of a longitudinal cross-sectional region of the center region and $\phi B$.

Further, in one exemplary embodiment, a novel method of manufacturing an image forming apparatus includes mounting an image bearing member to the image forming apparatus, disposing a developer container in a vicinity of the image bearing member in the image forming apparatus, arranging a developer carrying member opposite to the image bearing member with a portion thereof exposed from the opening of the developer container, installing a developer regulating member pressed by respective pressuring members at the axial end portions and held in contact with a surface of the developer carrying member, providing the developer regulating member with a center region having a first outer diameter of a first longitudinal cross-sectional region which increases toward an axial center portion of the developer regulating member according to a predetermined calculated amount of deflection of the developer regulating member and with side regions located at axial end portions, sandwiched in the center region therebetween, and having a second outer diameter of a second longitudinal cross-sectional region greater than a third outer diameter of a third longitudinal cross-sectional region obtained according to the predetermined calculated amount of deflection of the developer regulating member, and attaching sealing members to be held in contact with a surface of axial end portions of the developer carrying member. The sealing members have respective inner edges which sandwich boundaries between the center region and each of the side regions.

In one exemplary embodiment, a novel developing device includes a developer carrying member, a developer regulating member, and sealing members. The developer carrying member is configured to carry the developer on a surface thereof to the image bearing member. The developer regulating member is configured to regulate an amount of the developer carried by the developer carrying member. The developer regulating member may include a center region having a first outer diameter of a first longitudinal cross-sectional region which increases toward an axial center portion of the developer regulating member according to a predetermined calculated amount of deflection of the developer regulating member and side regions located at axial end portions, sandwiched in the center region therebetween, and having a second outer diameter of a second longitudinal cross-sectional region greater than a third outer diameter of a third longitudinal cross-sectional region obtained according to the predetermined calculated amount of deflection of the developer regulating member. The sealing members are configured to prevent the developer from leaking from the axial end portions of the developer carrying member. The sealing members have respective inner edges which sandwich boundaries between the center region and each of the side regions.

The above-described novel developing device may further include a developer container having an opening on a surface facing the image bearing member and configured to contain a developer. The developer carrying member is disposed opposite to the image bearing member with a portion thereof exposed from the opening of the developer container. The developer regulating member of the novel developing mechanism may be pressed by respective pressuring members at the axial end portions and be held in contact with a surface of the developer carrying member. The center region of the developer regulating member of the novel developing mechanism includes an image assuring area configured to assure availability of an image. The sealing members of the novel developing mechanism may be disposed in contact with the surface of the axial end portions of the developer carrying member.

In one exemplary embodiment, a novel process cartridge detachably mounted to an image forming apparatus includes a developing mechanism and at least one of an image bearing member configured to bear an electrostatic latent image on a surface thereof, a charging mechanism configured to uniformly charge the surface of the image bearing member, and a cleaning mechanism configured to remove developer remaining on the surface of the image bearing member. The developing mechanism may include a developer carrying member, a developer regulating member, and sealing members. The developer carrying member is configured to carry the developer on a surface thereof to the image bearing member. The developer regulating member is configured to regulate an amount of the developer carried by the developer carrying member. The developer regulating member may include a center region having a first outer diameter of a first longitudinal cross-sectional region which increases toward an axial center portion of the developer regulating member according to a predetermined calculated amount of deflection of the developer regulating member and side regions located at axial end portions, sandwiched in the center region therebetween, and having a second outer diameter of a second longitudinal cross-sectional region greater than a third outer diameter of a third longitudinal cross-sectional region obtained according to the predetermined calculated amount of deflection of the developer regulating member. The sealing members are configured to prevent the developer from leaking from the axial end portions of the developer carrying member. The sealing members have respective inner edges which sandwich boundaries of the center region and each of the side regions.

The above-described novel process cartridge may further include a developer container having an opening on a surface facing the image bearing member and configured to contain a developer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
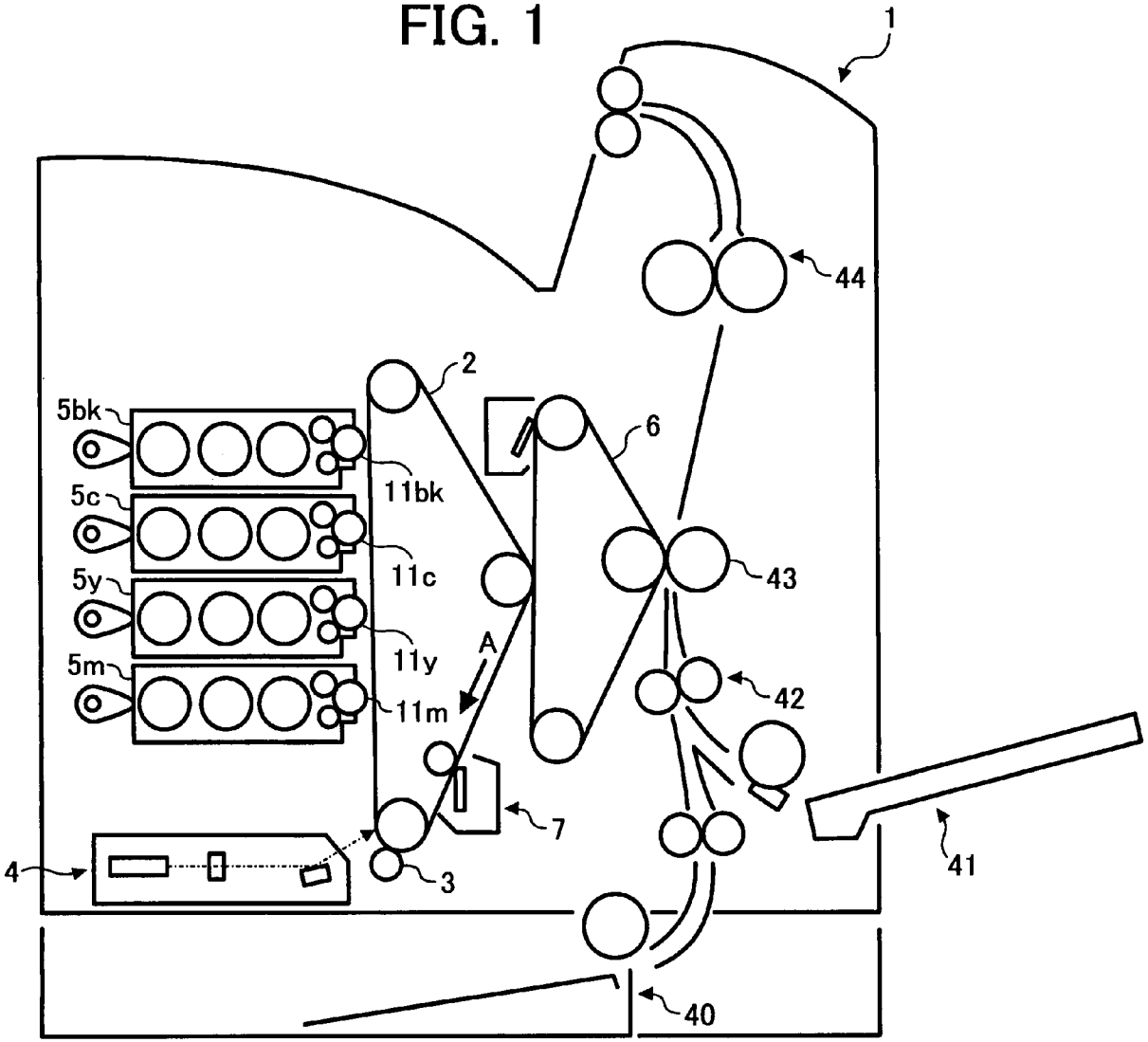
FIG. 1 is a schematic structure of an image forming apparatus according to an embodiment of the present invention.

In describing embodiments of the present invention illustrated in the drawings, specific terminology is employed for clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a schematic structure of a printer 1 as an image forming apparatus according to one exemplary embodiment of the present invention is described.

In FIG. 1, the printer 1 has an image forming mechanism including a photoconductive belt 2, a charging unit 3, an optical writing unit 4, four developing units 5*bk*, 5*c*, 5*y*, and 5*m*, an intermediate transfer belt 6, and a photoconductive belt cleaning unit 7.

The photoconductive belt 2 serves as an image bearing member and is supported by a plurality of supporting rollers. The photoconductive belt 2 rotates in a direction indicated by an arrow A, which is a clockwise direction in FIG. 1. The photoconductive belt 2 has a surface including an organic photoconductive layer.

The charging unit 3 uniformly charges the surface of the photoconductive belt 2.

The optical writing unit 4 optically writes one electrostatic latent image of a single color at a time on the surface of the photoconductive belt 2. In other words, the optical writing unit 4 emits a light beam to irradiate the surface of the photoconductive belt 2 so that an electrostatic latent image of a single color may be formed.

The four developing units 5*bk*, 5*c*, 5*y*, and 5*m* supply respective toners to corresponding electrostatic latent images formed on the surface of the photoconductive belt 2 and visualize the respective electrostatic latent images to respective toner images. Each of the four developing units 5*bk*, 5*c*, 5*y*, and 5*m* includes respective components that will be described later in detail.

The intermediate transfer belt 6 serves as a primary transfer member and is also supported with a plurality of supporting rollers. The intermediate transfer belt 6 subsequently receives the toner images of different colors from the photoconductive belt 2 to form an overlaid toner image.

The photoconductive belt cleaning unit 7 removes residual toner remaining on the surface of the photoconductive belt 2.

The printer 1 also has a sheet handling mechanism including a sheet feeding cassette 40, a manual sheet feeding tray 41, a conveyance roller pair 42, a sheet transfer roller 43, and a fixing roller pair 44.

The sheet feeding cassette 40 accommodates a plurality of recording media such as transfer sheets and feeds each transfer sheet therefrom to a sheet conveying path in the printer 1.

The manual sheet feeding tray 41 is an alternative means to feed a transfer sheet to the printer 1.

The conveyance roller pair 42 controls a movement of the transfer sheet to be synchronized with that of an image formed on the intermediate transfer belt 6.

The sheet transfer roller 43 serves as a secondary transfer member and is disposed opposite to one of the supporting roller for the intermediate transfer belt 6, facing the intermediate transfer belt 6 to form a nip portion.

The fixing roller pair 44 is disposed at an upper portion of the sheet transfer roller 43.

Operations for image forming performed by the printer 1 are described below.

When the printer 1 starts to perform image forming operations, for example a printing operation, the charging unit 3 is firstly applied with high a voltage to uniformly charge the surface of the photoconductive belt 2. An image signal processing unit (not shown) converts color image data, such as four color image signals transmitted by an external computer, into optical writing signals and transmits the optical writing signals to the optical writing unit 4. The optical writing unit 4 controls laser beams serving as light sources (not shown) based on the optical writing signals. The optical writing unit 4 then emits the respective light beams corresponding to the four image signals of black (bk), cyan (c), magenta (m), and yellow (y) via polygon mirrors, f-theta lenses and mirrors, to irradiate the surface of the photoconductive belt 2 so that each of respective electrostatic latent images is formed on the surface of the photoconductive belt 2.

The developing units 5*bk*, 5*c*, 5*m*, and 5*y* include respective color toners as developers that are charged to a polarity opposite to that applied to the respective electrostatic latent images. Accordingly, the respective charged color toners are attracted to the corresponding electrostatic latent images having the polarity opposite to the color toners and visualize the corresponding electrostatic latent images as respective toner images.

At a contact point of the photoconductive belt 2 and the intermediate transfer belt 6, a charge having a polarity opposite to that of the toner is applied to the intermediate transfer belt 6. This charge of the intermediate transfer belt 6 induces the toner images to be transferred onto a surface of the intermediate transfer belt 6. These toner image forming and transferring operations are repeated four times so that the four toner images can be overlaid to form an overlaid color toner image on the intermediate transfer belt 6.

While the overlaid color toner image is being formed in the image forming mechanism of the printer 1, a transfer sheet serving as a recording medium is fed from the sheet feeding cassette 40 or from the manual sheet feeding tray 41 via the conveyance roller pair 42 in the sheet handling mechanism thereof.

The overlaid color toner image formed on the intermediate transfer belt 6 is transferred onto the transfer sheet at the nip portion formed between the intermediate transfer belt 6 and the sheet transfer roller 43. The transfer sheet having the overlaid color toner image thereon is conveyed to the fixing roller pair 44 so that the overlaid color toner image is fixed onto the transfer sheet by heat and pressure.

Figure 2:
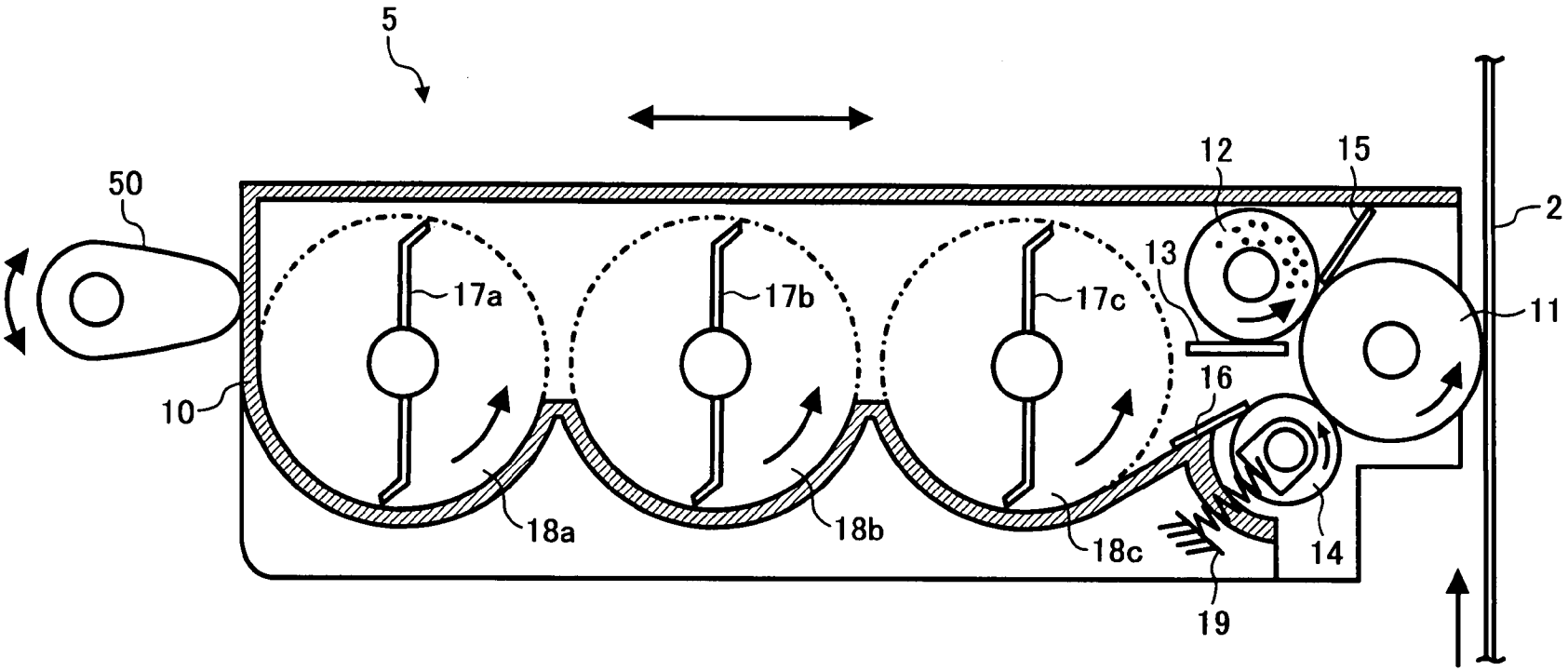
FIG. 2 is a schematic structure of a developing unit for use in the image forming apparatus of FIG. 1.

Referring to FIG. 2, a schematic structure of one of the developing units 5*bk*, 5*c*, 5*m*, and 5*y* is described. The developing units 5*bk*, 5*c*, 5*m*, and 5*y* have identical structures and functions except that they use toners of different colors. Therefore, the detailed descriptions below will be made with the reference numerals without related suffixes.

The developing unit 5 employs one-component developing method using a developer including nonmagnetic one-component toner. The nonmagnetic one-component toner is hereinafter referred to as "toner."

In FIG. 2, the developing unit 5 includes a developer container 10, a developing roller 11, a toner supplying roller 12, a toner regulating blade 13, a doctor roller 14, an inlet seal 15, a doctor roller cleaning blade 16, toner conveyance paddles 17*a*, 17*b*, and 17*c*, toner storages 18*a*, 18*b*, and 18*c*, a pressuring member 19, and a cam 50.

The developer container 10 includes an opening facing the photoconductive belt 2.

The developing roller 11 serves as a developer carrying member. The developing roller 11 includes a cored bar having a resin coated area greater in width than an image forming area in an axial direction. The developing roller 11 having the resin coated area carries and conveys the toner with retentivity of static electricity generated by friction caused between the resin and the toner. The toner having retentivity of static electricity may obtain high durability. A resin material used for the developing roller 11 may be selected from resin materials having non-staining properties with respect to an image bearing member such as the photoconductive belt 2. Specific examples of such resin materials are urea resins, melamine resins, alkyd resins, modified alkyd resins such as modified phenol resins and modified silicone resins, acrylic resins, silicone resins, fluorocarbon resins, phenol resins, polyamide resins, epoxy resins, polyester resins, maleic acid resins. Particularly, urea resins, melamine resins, acrylic resins and the like are preferably used from a viewpoint of deposition and adhesive properties.

The developing roller 11 has a portion exposed at an opening of the developer container 10. The developer roller 11 rotates at a predetermined linear velocity in a direction indicated by an arrow, which is a counterclockwise direction in FIG. 2. With the operation above, the developer roller 11 carries toner on the surface thereof to a developing area in which the developing roller 11 contacts the photoconductive belt 2, so that the electrostatic latent image formed on the photoconductive belt 2 can be developed to a toner image.

The toner supplying roller 12 serves as a developer supplying member and supplies the toner onto the surface of the developing roller 11. The toner supplying roller 12 has a surface formed by foamed polyurethane and is held in contact at a predetermined pressure with the developing roller 11. The toner supplying roller 12 is also held in contact with the toner regulating blade 13.

The toner regulating blade 13 regulates the amount of toner supplied to the surface of the developing roller 11.

The doctor roller 14 serves as a developer regulating member and is held in contact with the surface of the developing roller 11 to regulate the toner carried by the developing roller 11 to form a toner layer having a predetermined height. Details of the doctor roller 14 will be described later.

The inlet seal 15 is a sealing member for preventing the toner from falling from the surface of the developing roller 11 through the opening of the developer container 10. The inlet seal 15 is disposed at an inner surface of a top plate of the developer container 10 and has a leading edge extended to be held in contact with the surface of the developing roller 11.

Further, different sealing members (i.e., end sealing members 20 in FIG. 4) are also disposed at respective inner surfaces of side plates located perpendicular to a shaft of the developing roller 11. Details of the different sealing members will be described later.

The doctor roller cleaning blade 16 is held in contact with a surface of the doctor roller 14 to remove the toner remaining on the surface of the doctor roller 14.

The toner conveyance paddles 17*a*, 17*b*, and 17*c* convey the toner from the toner storages 18*a*, 18*b*, and 18*c* toward the toner supplying roller 12. Each of the toner conveyance paddles 17*a*, 17*b*, and 17*c* is disposed to rotate in a direction indicated by arrows, which is a counterclockwise direction in FIG. 2, so that the toner can be conveyed to the toner supplying roller 12. Materials used for the toner conveyance paddles 17*a*, 17*b*, and 17*c* may be soft and elastic materials such as polypropylene. The elasticity allows the toner conveyance paddles 17*a*, 17*b*, and 17*c* to be firmly contacted with the inner surface of the developer container 10 so that the toner can be surely conveyed toward the toner supplying roller 12 and the developing roller 11.

The pressuring member 19 supports each end of the doctor roller 14 so that the doctor roller 14 is pressed in contact with the developing roller 11.

The cam 50 is rotatably arranged in contact with a rear side of the developing unit 5, which is opposite to a side in which the developing roller 11 contacts the photoconductive belt 2. That is, the cam 50 is located at the leftmost of FIG. 2. The cam 50 controls contact and separation operations of the photoconductive belt 2. When the printer 1 is in a non-image forming operation, the cam 50 is released from the developing unit 5 to separate the developing roller 11 of the developing unit 5 from the photoconductive belt 2. When the printer 1 is ready to start an image forming operation, the cam 50 pushes the developing unit 5 toward the photoconductive belt 2 so that the developing roller 11 may be held in contact with the photoconductive belt 2'.

For example, when an electrostatic latent image for black is formed on the surface of the photoconductive belt 2, the cam (the cam 50 in FIG. 2) arranged at the rear side of the developing unit 5*bk* (the developing unit 5 in FIG. 2) is rotated to move the developing unit 5*bk* toward the photoconductive belt 2, so as to make the developing roller 11 bk (the developing roller 11 in FIG. 2) may contact with the surface of the photoconductive belt 2. For the developing units 5*c*, 5*m* and 5*y*, the same operation will be performed.

The doctor roller 14 includes a core bar and an elastic layer 14*a* including resin coated materials such as a urethane rubber and an epichlorohydrin rubber. The doctor roller 14 is held in contact with the surface of the developing roller 11 to regulate toner on the developing roller 11 to form a thin layer having a predetermined height and to frictionally charge the toner by contacting the toner. Further, the doctor roller 14 is also held in contact with the doctor roller cleaning blade 16 so that residual toner remaining on the surface of the doctor roller 14 may be removed downstream of the contact portion of the developing roller 11 and the doctor roller 14.

Figure 3:
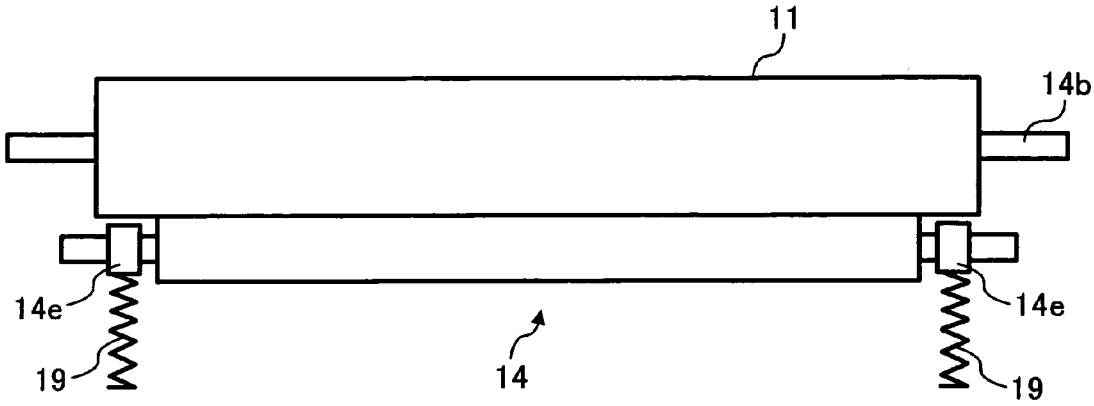
FIG. 3 is a schematic structure of a doctor roller pressed in contact with a developing roller of the developing unit of FIG. 2.

Further, FIG. 3 shows a schematic structure of the developing roller 11 and the doctor roller 14. As shown in FIG. 3, the respective pressuring members 19 support respective ends of a doctor roller shaft 14*b* via respective doctor roller bearings 14*e*, and the pressuring member 19 presses the doctor roller 14 against the developing roller 11. Pressing the doctor roller 14 against the developing roller 11 can prevent variation in contact conditions between the developing roller 11 and the doctor roller 14 due to environmental changes such as humidity.

Next, a shape of the doctor roller 14 in an axial direction is described in detail.

Figure 4:
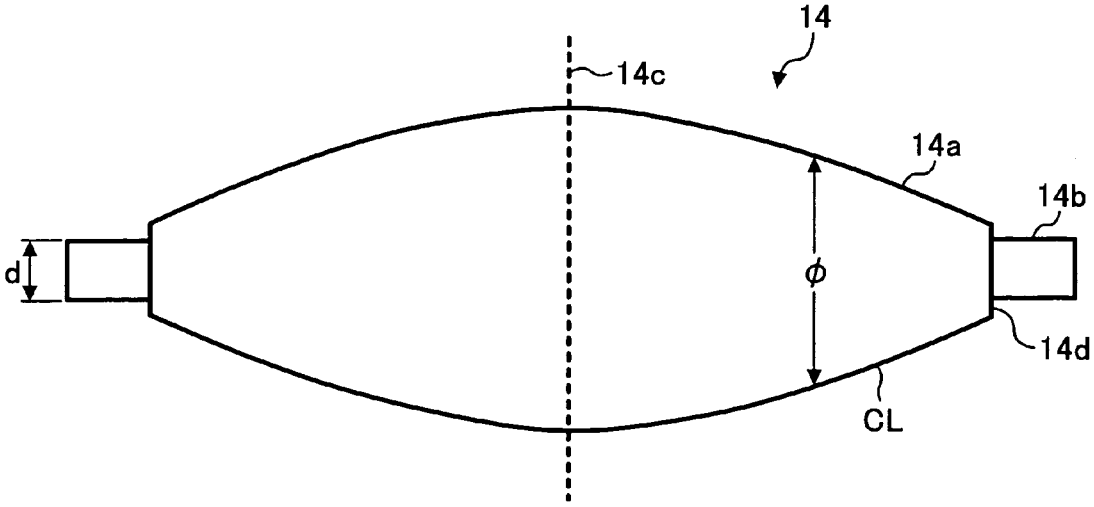
FIG. 4 is a schematic structure of a doctor roller having different outer diameters of longitudinal cross-sectional regions thereof in accordance with deflection thereof.

Referring to FIG. 4, the shape of the doctor roller 14 is described.

If the doctor roller 14 is formed to have a uniform outer diameter of a longitudinal cross-sectional region thereof, a deflection may be generated along the doctor roller 14 because amounts of load constantly applied to the doctor roller 14 are different at different points on the doctor roller 14. When the deflection is generated, a contact pressure of the doctor roller 14 applied against the developing roller 11 may differ according to the position in an axial direction. Once the contact pressure between the developing roller 11 and the doctor roller 14 becomes uneven, a pressure applied to the toner layer on the surface of the developing roller 11 may vary. For example, a toner charge volume may partially decrease at a portion of a toner layer having a height greater than a predetermined height.

To provide a uniform contact pressure between the doctor roller 14 and the developing roller 11, embodiments of the present invention employ a doctor roller 14 having a shape as shown in FIG. 4. That is, the doctor roller 14 has an outer diameter of a longitudinal cross-sectional region at a doctor roller center 14*c* greater than that at a doctor roller end 14*d*, and is formed to be axially symmetrical at the doctor roller center 14*c*.

Here, deflection of the doctor roller 14 is calculated by using a model equation of a simply supported beam for a uniform load as follows:

$$w=q*L^4/(24EI)*(x/L)*(1-2*(x/L)^2+(x/L)^3),$$

in which "w" expresses deflection in a position x, "q" expresses a value obtained dividing the entire load by a length of the doctor roller 14, "L" expresses a length of the doctor roller 14, "E" expresses Young's modulus of the doctor roller shaft 14*b*, "I" expresses moment of inertia, which is $\pi*d^4/64$, and "d" expresses an outer diameter of the doctor roller shaft 14*b*.

According to the above-described equation, w is a quartic function of x. Then, an outer diameter $\phi$ shown in FIG. 4 may be changed according to a curve based on the above-described quartic function in an axial direction. When compared to other curves using other functions, the doctor roller 14 can be pressed further evenly against the developing roller 11. This can form a uniform toner layer on the developing roller 11 and provide constant volume of toner charge to prevent the toner charge from being partially deteriorated, so that an image quality may be improved.

In FIG. 4, an outer diameter curve CL indicates an outline shape of the doctor roller 14 in an axial direction according to the quartic function. The outline shape of the doctor roller 14 in FIG. 4 is described in an exaggerated manner. In fact, a difference between an outer diameter at the doctor roller center 14*c* and that at the doctor roller end 14*d* falls in a range of from 50 micrometers to some hundred micrometers.

The toner removed by the doctor roller 14 from the developing roller 11 tends to flow in a direction from the doctor roller center 14*c* to the doctor roller end 14*d*. The flow of toner is stopped by the end sealing members 20.

Figure 5:
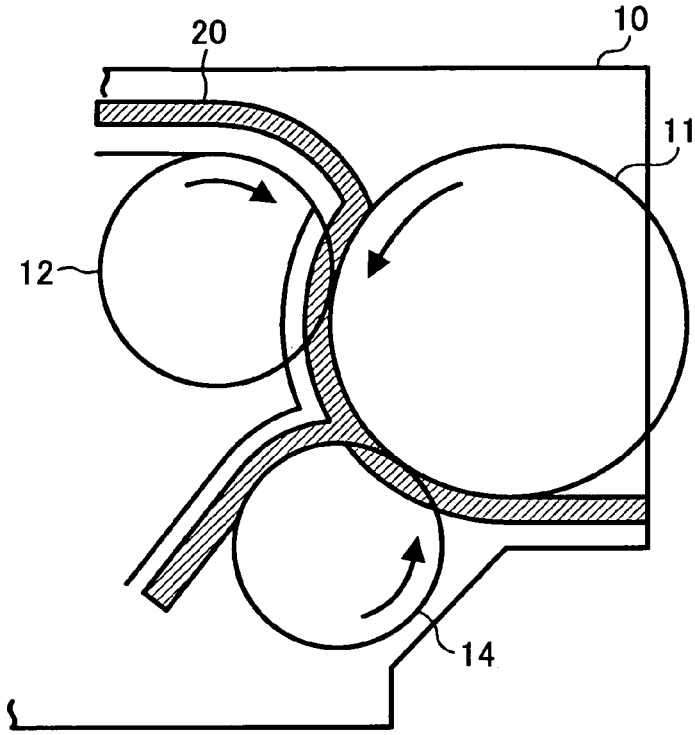
FIG. 5 is a cross-sectional view of one of end sealing members arranged at one end of the developing roller in the developing unit of FIG. 2.
Figure 6:
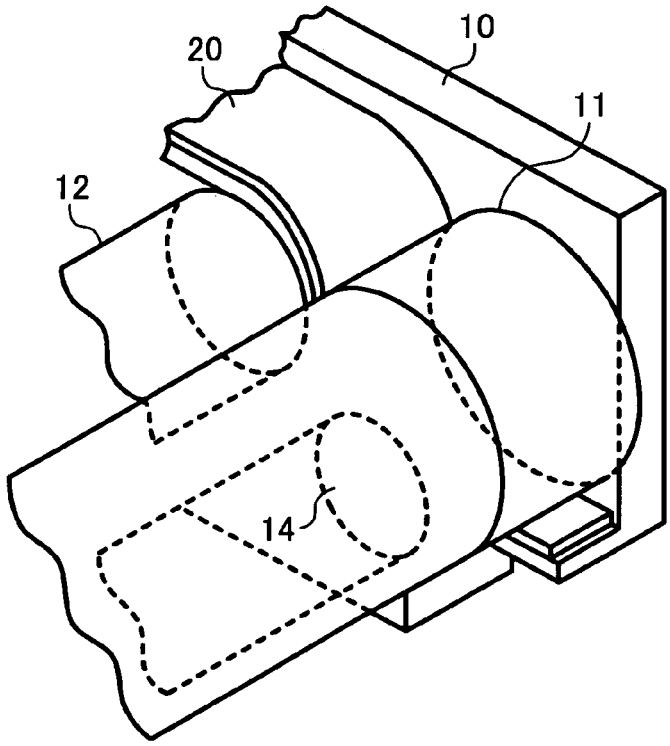
FIG. 6 is a perspective view of the end sealing member of FIG. 5.
Figure 7:
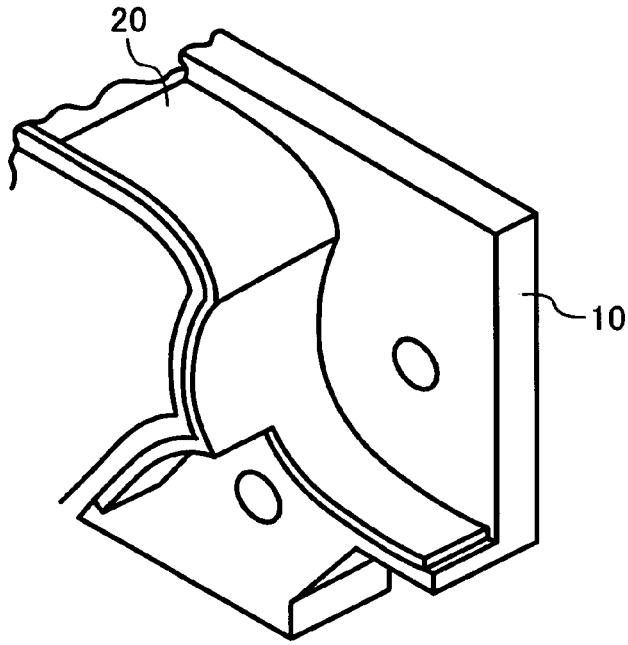
FIG. 7 is a perspective view of the developer container in which the end sealing member is disposed.

Referring to FIGS. 5 through 7, a structure of the end sealing members 20 is described. FIGS. 5 and 6 are cross sectional and perspective views, both indicating a position of one of the end sealing members 20 of the developing roller 11. FIG. 7 is a perspective view of a side plate of the developer container 10 indicating the position of one of the end sealing members 20 of the developing roller 11.

As shown in FIGS. 5 and 6, the end sealing member 20 is held in contact with the surface of the developing roller 11. The end sealing member 20 is provided for regulating a width of the toner layer of the developing roller 11 so as to prevent the toner from leaking through a gap formed between the developer container 10 and axial ends of the developing roller 11. As shown in FIG. 7, the end sealing member 20 is disposed at the inner side of the developer container 10 to prevent a toner overflow.

Figure 8:
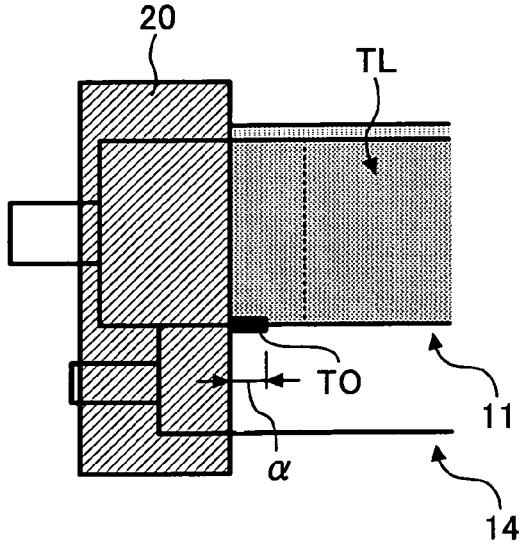
FIG. 8 is a partial view of the developer roller and the doctor roller having a toner overflow.
Figure 9:
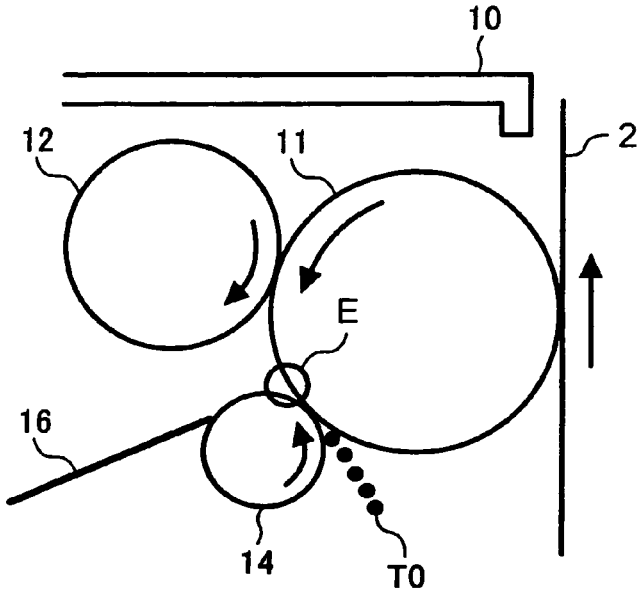
FIG. 9 is a side view of the developer roller and the doctor roller having a toner overflow.

Referring to FIGS. 8 and 9, a mechanism of a toner overflow occurring in a vicinity of an inner edge of the end sealing member 20 at one end of the developing roller 11 and the doctor roller 14 is described. Even though the following descriptions in reference with FIGS. 8 and 9 will explain one of the end sealing members 20 of the doctor roller 14, the explanation will be applied to both of the end sealing members 20 arranged respectively with axial end portions of the doctor roller 14.

FIG. 8 shows a partial structure at one end of the doctor roller 14. In FIG. 8, the developing roller 11 has the surface held in contact with that of the doctor roller 14, and a toner layer TL on the surface thereof regulated by the end sealing member 20 at one end thereof. There is an area a in a vicinity of the end sealing member 20, in which a substantially larger amount of pressure of toner powder may be generated compared to that of other areas. As shown in FIG. 8, when the toner is accumulated at an inner edge of the end sealing member 20 and a contact pressure of the doctor roller 14 against the developing roller 11 cannot prevent the toner moving in a rotation direction of the developing roller 11, a toner overflow TO occurs at the end of the toner layer TL, that is, at the inner edge of the end sealing member 20.

As shown in FIG. 9, the toner overflow TO is a toner leakage that occurs such that toner passes a contact portion of the developing roller 11 and the doctor roller 14 out of an area E in which the toner is generally stopped by the doctor roller 14 and goes out of the developer container 10 from a downstream of rotation of the developing roller 11. The toner overflow TO may contaminate an inside of the image forming apparatus including the photoconductive belt 2 and the developing units 5 having different colors from that of the leaked toner, which may result in deterioration of image quality.

Figure 10:
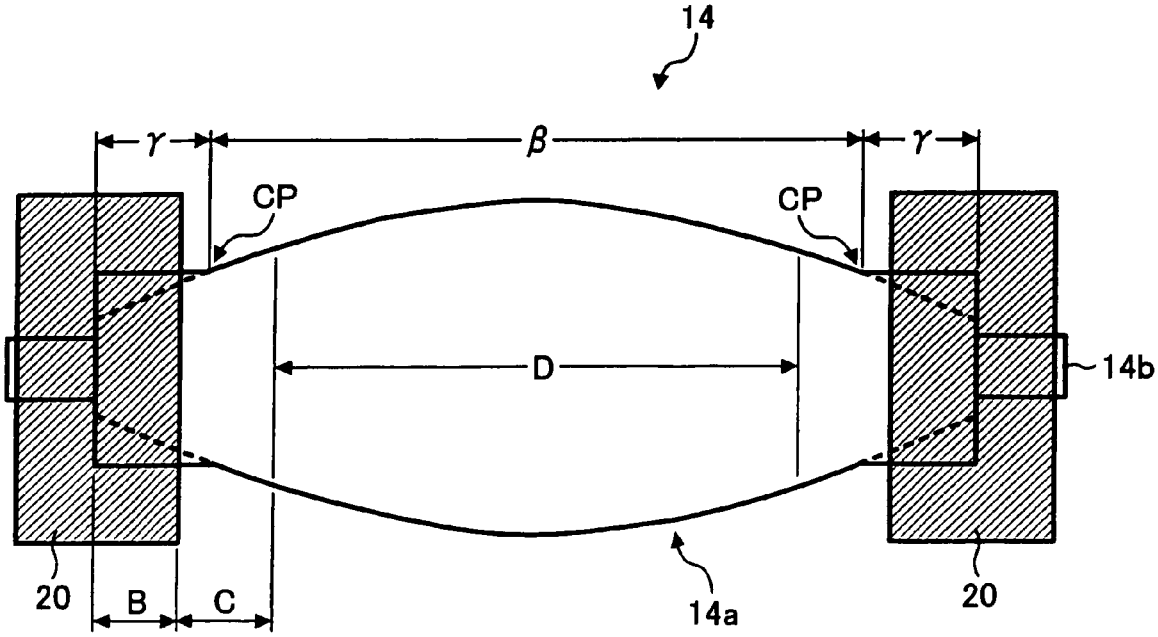
FIG. 10 is a schematic structure of a doctor roller having outer diameters at the end thereof greater than those at the end of the doctor roller of FIG. 4.

To prevent the toner overflow TO, the doctor roller 14 according to the present invention is formed as shown in FIG. 10.

The doctor roller 14 of the present invention includes side regions γ from a predetermined point closer to the doctor roller center 14*c* than the inner edge of the end sealing member 20 to each doctor roller end 14*d*, so that an outer diameter of a longitudinal cross-sectional region in the side regions γ may have an outer diameter of a longitudinal cross-sectional region greater than that corresponding to the outer diameter curve CL, as shown in FIG. 4, which is obtained based on a general formula for calculating deflection of the doctor roller 14. The doctor roller 14 also includes a center region β in which an outer diameter of a longitudinal cross-section area of the doctor roller 14 is determined based on the outer diameter curve CL. Accordingly, the doctor roller 14 has three areas, the center region β and two side regions γ in an axial direction. A border of the center region β and each of the side regions γ is defined as an inflection point CP.

As shown in FIG. 10, the side region of the doctor roller 14 includes the outer diameter of the longitudinal cross-sectional region greater than that corresponding to the outer diameter curve CL indicated by dotted lines in the side regions γ. The doctor roller 14 also has the inflection point CP at an inner side in a vicinity of the inner edge of the end sealing members 20, that is, the end of the toner layer TL on the surface of the doctor roller 14. The doctor roller 14 of FIG. 10 allows a larger amount of contact pressure at the center region β than the contact pressure of the doctor roller 14 in the vicinity of the respective end sealing members 20, thereby preventing the toner overflow at the end portion of the toner layer TL. That is, providing the side region γ from a predetermined point in an area C to an entire area B allows the contact pressure of the doctor roller 14 with respect to the developing roller in the area α in FIG. 8 to be greater than that in the center region β, thereby preventing the toner overflow TO in the area α.

However, when the inflection point CP is within an end sealing area, that is, when the side regions γ covers the area B solely, the contact pressure in the vicinity of the inner edge of the end sealing member 20 cannot be increased, and the toner overflow TO may not be prevented.

Further, the inflection point CP should be determined outside each end of an image assuring area D (i.e., outside a boundary between the area C and the image assuring area D) that is a maximum width assuring quality of images to be formed. In the image assuring area D, the contact pressure needs to be as uniform as possible so as not to cause, for example, density deviation in an axial direction. Therefore, it is preferable that the inflection point CP is prepared outside the image assuring area D.

A portion from the inflection point CP to the doctor roller end 14*d*, however, is the side regions γ in which a contact pressure thereof becomes greater than that generated inside the inflection point CP. Therefore, the height of the toner layer TL becomes smaller in the area αthan that in the image assuring area D. This provides uniformity on the toner layer TL in the image assuring area D, and prevents the toner overflow TO that may occur in the vicinity of the respective end sealing members 20.

Some parameters for the doctor roller 14 of an exemplary embodiment of the present invention are now presented.

These parameters are meant to facilitate an understanding of the present invention and are not limiting of the scope of the present invention.

The diameter of the doctor roller 14 is approximately ϕ14 mm, including a rubber-based layer of approximately 1 mm. The difference between the maximum outer diameter at the center and the outer diameter at the inflection point is set to approximately 240 μm. Each of the distance between respective end sealing members and the inflection point is set to approximately 2 mm, which is approximately 7 mm from an inner edge of the doctor roller 14. The overlapping lengths of each of the end sealing members 20 and the doctor roller 14 are approximately 5 mm. The difference of outer diameters of the doctor roller end 14*d* and the inflection point CP is 0. The axial length of the doctor roller 14 is approximately 320 mm. The width of image assuring area D is set to approximately 300 mm.

Figure 11:
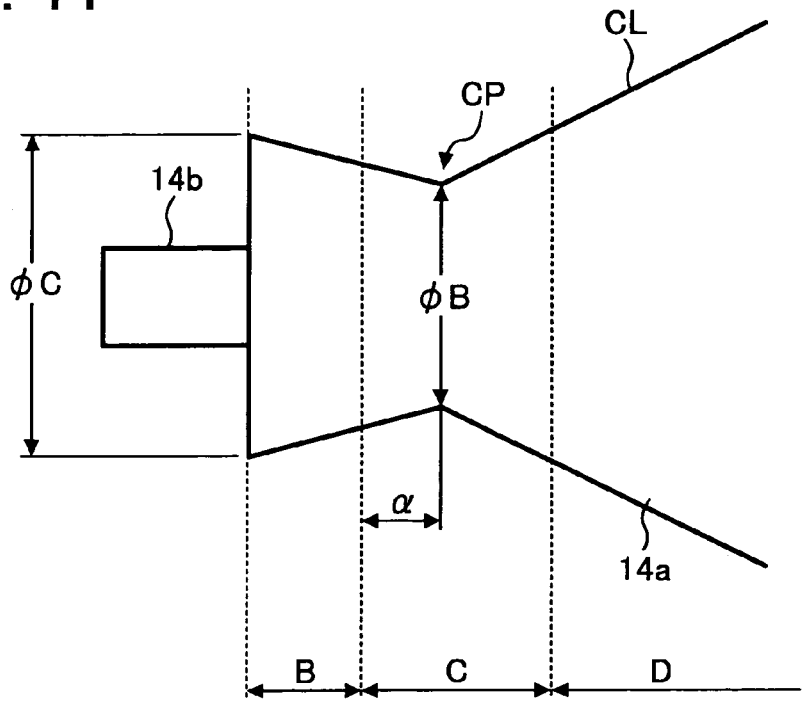
FIG. 11 is an enlarged view of the doctor roller of FIG. 10.

As shown in FIG. 11, the outer diameter of the longitudinal cross-sectional region of the doctor roller 14 at the inflection point CP is defined as ϕB, and the outer diameter of the longitudinal cross-sectional region of the doctor roller 14 at the doctor roller end 14*d* is defined as ϕC. Then, a range of the differences of the outer diameter ϕC at the doctor roller end 14*d* and the outer diameter ϕB at the inflection point CP (ϕC−ϕB) was proved. At this time, the outer diameter ϕC at the doctor roller end 14*d* is a maximum outer diameter in the side region γ.

Repeated tests have proven that fogging over the image assuring area D and the toner overflow TO that occurs in the vicinity of the respective end sealing members 20 may be prevented by determining the difference of outer diameter from the inflection point CP to the doctor roller end 14*d* to be ±20 μm. When the distance is below minus 20 μm, the toner overflow may occur. On the other hand, when the distance is above plus 20 μm, the contact pressure at the doctor roller center 14*c* decreases, and fogging may be generated.

A tolerance level of the difference of the outer diameters (ϕC−ϕB) may depend on deflection of the doctor roller 14. Provided that a difference between the maximum outer diameter at the center of the doctor roller 14 obtained according to the calculated deflection and the outer diameter at the inflection point CP is defined as dϕ, the doctor roller 14 of the present invention is determined such that the difference dϕ is 240 μm and the difference between the outer diameters ϕB and ϕC is ±20 μm. Thereby, an absolute value of the difference between the outer diameters ϕB and ϕC is preferably in a range within dϕ/10, and more preferably in a range within dϕ/20, that is, an absolute value of the difference between the outer diameters ϕB and ϕC is preferably smaller than or equal to dϕ/10, and more preferably smaller than or equal to dϕ/20, so that the toner overflow and fogging may surely be prevented.

According to the present invention, the outer diameter of the longitudinal cross-sectional region at the doctor roller center 14*c* is formed greater than that at the doctor roller end 14*d*, and the doctor roller 14 is formed axially symmetric centering on the doctor roller center 14*c*. At this time the outer diameter is determined according to the outer diameter curve CL of a quartic function including the doctor roller center 14*c* as its top so that the doctor roller 14 can contact the developing roller 11 in proportion to the deflection of the doctor roller 14. Forming the outer diameter of the doctor roller 14 according to its deflection may uniformly apply the contact pressure of the doctor roller 14 with respect to the developing roller 11, which may form a uniform toner layer TL. Further, the doctor roller 14 has the side regions γ in which the outer diameter from the respective inner edge of the end sealing members 20 toward the doctor roller end 14*d* is greater than that according to the outer diameter curve CL. With the above-described structure, a contact pressure of the doctor roller 14 against the developing roller 11 in the area a in the vicinity of the respective inner edges of the end sealing members 20 becomes greater than a contact pressure in the center region β, thereby preventing the toner overflow TO in the area a at the end of the toner layer TL.

Further, since the side regions γ in which a contact pressure becomes greater than the other area is formed outside the image assuring area D, the image assuring area D may have a uniform contact pressure and a uniform toner layer TL.

Further, the outer diameter curve CL is formed according to a curve of a quartic function for obtaining deflection of the simply supported beam with a general uniform load. This curve of the quartic function can flexibly be applied to the deflection of the doctor roller 14, thereby obtaining a uniform contact pressure, resulting in forming a toner layer TL having a further uniform height.

Further, the outer diameter ϕC at the doctor roller end 14*d* satisfies ϕC−ϕB=dϕ/10, with respect to the difference dϕ of the outer diameters of the inflection point CP and the doctor roller center 14*c* and the outer diameter ϕB of the inflection point CP. This prevents fogging due to a greater diameter in the side regions γ and toner overflow due to the smaller outer diameter in the side region γ.

In this embodiment of the present invention uses a quartic function for obtaining deflection of the simply supported beam with a general uniform load, as the outer diameter curve CL. However, this is not limited to an outer diameter of the doctor roller according to the shape of the deflection. For example, the present invention may be applied to a doctor roller having a structure using, for example, a quadratic function and a circular. That is, the present invention may be applied when a contact pressure of a doctor roller against a developing roller is uniform at both ends thereof in an axial direction by providing a side region having the contact pressure greater than the other areas.

The embodiment of the present invention shows the structure of the printer 1 serving as an image forming apparatus having one photoconductive belt 2 held in contact with a plurality of developing rollers 11*bk*, 11*c*, 11*y* and 11*m*. However, the present invention is not limited to the above-described structure, but can be applied to another image forming apparatus having a plurality of individual photoconductive rollers.

Figure 12:
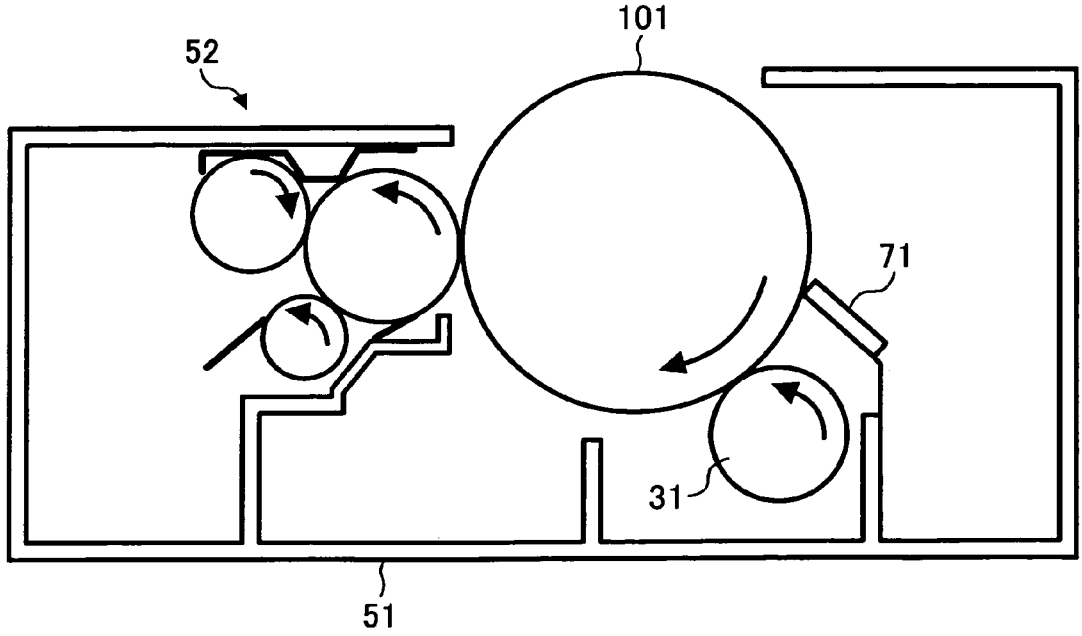
FIG. 12 is a schematic structure of a process cartridge according to the embodiment of the present invention.

Referring now to FIG. 12, a schematic structure of an image forming apparatus having a plurality of individual photoconductive rollers according to another embodiment of the present invention is described. In FIG. 12, the image forming mechanism includes a photoconductive roller 101, a charging unit 31, a cleaning unit 71, and a developing unit 52, and is integrally supported as a process cartridge 51. The process cartridge 51 may be integrally mounted with an image bearing mechanism and at least one of a charging mechanism, a developing mechanism and a cleaning mechanism, and be detachable with respect to the image forming apparatus such as a copier, a printer, etc.

Since the process cartridge 51 employs the developing unit 52 including the doctor roller 14, the toner layer in the image assuring area D may be uniformly formed, and good quality in image without toner contamination may be maintained. Further, the process cartridge 51 may facilitate a maintenance and replacement of the image forming mechanism.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image bearing member configured to bear an electrostatic latent image on a surface thereof;

a developer carrying member configured to carry a developer on a surface thereof to the image bearing member;

a developer regulating member configured to regulate an amount of the developer carried by the developer carrying member, the developer regulating member comprising:

a center region having a first outer diameter of a first longitudinal cross-sectional region which increases toward an axial center portion of the developer regulating member according to a predetermined calculated amount of deflection of the developer regulating member; and side regions located at axial end portions, sandwiched the center region therebetween and have a second outer diameter of a second longitudinal cross-sectional region greater than a third outer diameter of a third longitudinal cross-sectional region obtained according to the predetermined calculated amount of deflection of the developer regulating member; and sealing members configured to prevent the developer from leaking from axial end portions of the developer carrying member, the sealing members having respective inner edges which sandwich boundaries between the center region and each of the side regions.

2. The image forming apparatus according to claim 1, further comprising:

a developer container having an opening on a surface facing the image bearing member and configured to contain the developer, wherein:

the developer carrying member is disposed opposite to the image bearing member with a portion thereof exposed from the opening of the developer container;

the developer regulating member is pressed by respective pressuring members at the axial end portions and is held in contact with a surface of the developer carrying member;

the center region of the developer regulating member includes an image assuring area configured to assure availability of an image; and the sealing members are disposed in contact with a surface of the axial end portions of the developer carrying member.

3. The image forming apparatus according to claim 2, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

4. The image forming apparatus according to claim 2, wherein:

the developer regulating member is determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the developer regulating member at an axial end, and $d\phi$ expresses a difference between a maximum outer diameter of a longitudinal cross-sectional region of the center region and $\phi B$.

5. An image forming apparatus, comprising:

means for bearing an electrostatic latent image on a surface thereof;

means for carrying a developer on a surface thereof to the means for bearing;

means for regulating an amount of the developer carried by the means for carrying, the means for regulating comprising:

a center region having a first outer diameter of a first longitudinal cross-sectional region which increases toward an axial center portion of the means for regulating according to a predetermined calculated amount of deflection of the means for regulating; and side regions located at axial end portions, sandwiched the center region therebetween and have a second outer diameter of a second longitudinal cross-sectional region greater than a third outer diameter of a third longitudinal cross-sectional region obtained according to the predetermined calculated amount of deflection of the means for regulating; and means for preventing the developer from leaking from axial ends of the means for carrying, the means for preventing having an inner edge which lies closer to each of the axial ends than boundaries between the center region and each of the side regions.

6. The image forming apparatus according to claim 5, further comprising:

means for containing a developer, the means for containing having an opening on a surface facing the means for bearing, wherein:

the means for regulating is pressed by respective pressuring members at the axial end portions and is held in contact with a surface of the means for carrying; and the center region of the means for regulating includes an image assuring area configured to assure availability of an image.

7. The image forming apparatus according to claim 6, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

8. The image forming apparatus according to claim 6, wherein:

the means for regulating is determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the means for regulating at an axial end, and $d\phi$ expresses a difference between a maximum outer diameter of a longitudinal cross-sectional region of the center region and $\phi B$.

9. A method of manufacturing an image forming apparatus, comprising:

mounting an image bearing member to the image forming apparatus;

disposing a developer container in a vicinity of the image bearing member in the image forming apparatus;

arranging a developer carrying member opposite to the image bearing member with a portion thereof exposed from an opening of the developer container;

installing a developer regulating member pressed by respective pressuring members at axial end portions and held in contact with a surface of the developer carrying member;

providing the developer regulating member with a center region having a first outer diameter of a first longitudinal cross-sectional region which increases toward an axial center portion of the developer regulating member according to a predetermined calculated amount of deflection of the developer regulating member, and side regions located at axial end portions sandwiched the center region therebetween and have a second outer diameter of a second longitudinal cross-sectional region greater than a third outer diameter of a third longitudinal cross-sectional region obtained according to the predetermined calculated amount of deflection of the developer regulating member; and attaching sealing members to be held in contact with a surface of axial end portions of the developer carrying member, the sealing members having respective inner edges which sandwich boundaries between the center region and each of the side regions.

10. The method according to claim 9, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

11. The method according to claim 9, wherein:

the developer regulating member is determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the developer regulating member at and axial end, and $d\phi$ expresses a difference between a maximum outer diameter of a longitudinal cross-sectional region of the center region and $\phi B$.

12. A developing device, comprising:

a developer carrying member configured to carry a developer on a surface thereof to an image bearing member;

a developer regulating member configured to regulate an amount of the developer carried by the developer carrying member, the developer regulating member comprising:

a center region having a first outer diameter of a first longitudinal cross-sectional region which increases toward an axial center portion of the developer regulating member according to a predetermined calculated amount of deflection of the developer regulating member; and side regions located at axial end portions, sandwiched the center region therebetween and have a second outer diameter of a second longitudinal cross-sectional region greater than a third outer diameter of a third longitudinal cross-sectional region obtained according to the predetermined calculated amount of deflection of the developer regulating member; and sealing members configured to prevent the developer from leaking from axial ends of the developer carrying member, the sealing members having respective inner edges which sandwich boundaries of the center region and each of the side regions.

13. The developing device according to claim 12, further comprising:

a developer container having an opening on a surface facing the image bearing member and configured to contain the developer, wherein:

the developer carrying member is disposed opposite to the image bearing member with a portion thereof exposed from the opening of the developer container;

the developer regulating member is pressed by respective pressuring members at the axial end portions and is held in contact with a surface of the developer carrying member;

the center region of the developer regulating member includes an image assuring area configured to assure availability of an image; and the sealing members are disposed in contact with the surface of the axial end portions of the developer carrying member.

14. The developing device according to claim 13, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

15. The developing device according to claim 13, wherein:

the developer regulating member is determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the developer regulating member at an axial end, and $d\phi$ expresses a difference between a maximum outer diameter of a longitudinal cross-sectional region of the center region and $\phi B$.

16. A developing device, comprising:

means for carrying a developer on a surface thereof to a means for bearing;

means for regulating an amount of the developer carried by the means for carrying, the means for regulating comprising:

a center region having a first outer diameter of a first longitudinal cross-sectional region which increases toward an axial center portion of the means for regulating according to a predetermined calculated amount of deflection of the means for regulating; and side regions located at axial end portions, sandwiched the center region therebetween and have a second outer diameter of a second longitudinal cross-sectional region greater than a third outer diameter of a third longitudinal cross-sectional region obtained according to the predetermined calculated amount of deflection of the means for regulating; and means for preventing the developer from leaking from axial ends of the means for carrying, the means for preventing having an inner edge which lies closer to each of the axial ends than boundaries between the center region and each of the side regions.

17. The developing device according to claim 16, further comprising:

means for containing a developer, the means for containing having an opening on a surface facing the means for bearing, wherein:

the means for regulating is pressed by respective pressuring members at the axial end portions and is held in contact with a surface of the means for carrying; and the center region of the means for regulating includes an image assuring area configured to assure availability of an image.

18. The developing device according to claim 17, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

19. The developing device according to claim 17, wherein:

the means for regulating is determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the means for regulating at an axial end, and $d\phi$ expresses a difference between a maximum outer diameter of a longitudinal cross-sectional region of the center region and $\phi B$.

20. A process cartridge detachably mounted to an image forming apparatus, comprising:

at least one of:

an image bearing member configured to bear an electrostatic latent image on a surface thereof;

a charging mechanism configured to uniformly charge the surface of the image bearing member; and a cleaning mechanism configured to remove developer remaining on the surface of the image bearing member; combined with a developing mechanism, comprising:

a developer carrying member configured to carry the developer on a surface thereof to the image bearing member;

a developer regulating member configured to regulate an amount of the developer carried by the developer carrying member, the developer regulating member comprising:

a center region having a first outer diameter of a first longitudinal cross-sectional region which increases toward an axial center portion of the developer regulating member according to a predetermined calculated amount of deflection of the developer regulating member; and side regions located at axial end portions, sandwiched the center region therebetween and have a second outer diameter of a second longitudinal cross-sectional region greater than a third outer diameter of a third longitudinal cross-sectional region obtained according to the predetermined calculated amount of deflection of the developer regulating member; and sealing members configured to prevent the developer from leaking from axial end portions of the developer carrying member, the sealing members having respective inner edges which sandwich boundaries between the center region and each of the side regions.

21. The process cartridge according to claim 20, further comprising:

a developer container having an opening on a surface facing the image bearing member and configured to contain a developer, wherein:

the developer carrying member is disposed opposite to the image bearing member with a portion thereof exposed from the opening of the developer container;

the developer regulating member is pressed by respective pressuring members at the axial end portions and is held in contact with a surface of the developer carrying member;

the center region of the developer regulating member includes an image assuring area configured to assure availability of an image; and the sealing members are disposed in contact with the surface of the axial end portions of the developer carrying member.

22. The process cartridge according to claim 21, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

23. The process cartridge according to claim 21, wherein:

the developer regulating member is determined such that an absolute value of a difference between outer diameters $\phi B$ and $\phi C$ is in a range within $d\phi/10$, in which $\phi B$ expresses a fourth outer diameter of a fourth longitudinal cross-sectional region at the boundaries between the center region and each of the side regions, $\phi C$ expresses a fifth outer diameter of a fifth longitudinal cross-sectional region of the developer regulating member at an axial end, and dϕ expresses a difference between a maximum outer diameter of a longitudinal cross-sectional region of the center region and ϕB.

24. A process cartridge detachably disposed to an image forming apparatus member, comprising:

at least one of:

means for bearing an electrostatic latent image on a surface thereof;

means for charging the surface of the image bearing member uniformly; and means for removing developer remaining on the surface of the image bearing member; and means for developing, comprising:

means for carrying the developer on a surface thereof to the means for bearing;

means for regulating an amount of the developer carried by the means for carrying, the means for regulating comprising:

a center region having a first outer diameter of a first longitudinal cross-sectional region which increases toward an axial center portion of the means for regulating according to a predetermined calculated amount of deflection of the means for regulating; and side regions located at axial end portions, sandwiched the center region therebetween and have a second outer diameter of a second longitudinal cross-sectional region greater than a third outer diameter of a third longitudinal cross-sectional region obtained according to the predetermined calculated amount of deflection of the means for regulating; and means for preventing the developer from leaking from axial ends of the means for carrying, the means for preventing having an inner edge which lies closer to each of the axial ends than boundaries between the center region and each of the side regions.

25. The process cartridge according to claim 24, further comprising:

means for containing a developer, the means for containing having an opening on a surface facing the means for bearing, wherein:

the means for regulating is pressed by respective pressuring members at the axial end portions and is held in contact with a surface of the means for carrying; and the center region of the means for regulating includes an image assuring area configured to assure availability of an image.

26. The process cartridge according to claim 25, wherein:

the first outer diameter of the first longitudinal cross-sectional region of the center region varies according to a value obtained by a general formula for deflection of a simply supported beam with a uniform load applied; and the second outer diameter of the second longitudinal cross-sectional region of each of the side regions is constantly greater than a value obtained by the general formula.

27. The process cartridge according to claim 25, wherein:

the means for regulating is determined such that an absolute value of a difference between outer diameters ϕB and ϕC is in a range within dϕ/10, in which ϕB expresses a fourth outer diameter of a fourth longitudinal cross-sectional region at the boundaries between the center region and each of the side regions, ϕC expresses a fifth outer diameter of a fifth longitudinal cross-sectional region of the means for regulating at an axial end, and dϕ expresses a difference between a maximum outer diameter of a longitudinal cross-sectional region of the center region and ϕB.

* * * * *